United States Patent [19]

McLaughlin

[11] 3,975,073

[45]*Aug. 17, 1976

[54] FLUORESCENT LAMPHOLDER WITH MEANS FOR CIRCUIT INTERRUPTION

[75] Inventor: Emmett J. McLaughlin, Fairfield, Conn.

[73] Assignee: Westinghouse Electric Corporation, Pittsburgh, Pa.

[ * ] Notice: The portion of the term of this patent subsequent to Apr. 4, 1989, has been disclaimed.

[22] Filed: Dec. 2, 1971

[21] Appl. No.: 204,285

[52] U.S. Cl. ..... 339/53
[51] Int. Cl.[2] ..... H01R 33/08
[58] Field of Search ..... 339/50–57

[56] References Cited

UNITED STATES PATENTS

| | | | |
|---|---|---|---|
| 2,241,065 | 5/1941 | Hawkins | 339/53 R X |
| 2,555,524 | 6/1951 | Wold | 339/53 |
| 2,659,058 | 11/1953 | Russell | 339/53 R |
| 2,767,349 | 10/1956 | Feinberg | 339/53 R X |
| 3,005,175 | 10/1961 | Pistey | 339/50 R |
| 3,017,598 | 1/1962 | Low | 339/91 R X |
| 3,401,242 | 9/1968 | McLaughlin | 339/53 R X |
| 3,651,445 | 3/1972 | Francis | 339/53 |
| 3,651,445 | 3/1972 | Francis | 339/53 R |
| 3,654,587 | 4/1972 | McLaughlin | 339/53 R |

*Primary Examiner*—Roy D. Frazier
*Assistant Examiner*—Terrell P. Lewis
*Attorney, Agent, or Firm*—G. H. Telfer

[57] ABSTRACT

A lampholder with means for circuit interruption upon lamp removal is provided with a pair of circuit interrupting contact members that are located within a housing by means of projections from the housing front and back elements. One of the contact members has a pin contacting portion substantially perpendicular with the housing front wall and having a pair of pin locating projections thereon. Insertion of a lamp causes the first contact member to be forced outwardly to contact the second contact member in a manner that results in a contact wiping action therebetween. The contact means for the other lamp pin is preferably of the type having a pin contacting portion that is flat and parallel with the housing front wall.

5 Claims, 3 Drawing Figures

FLUORESCENT LAMPHOLDER WITH MEANS FOR CIRCUIT INTERRUPTION

BACKGROUND OF THE INVENTION

1. Field of the Invention

The invention relates generally to electrical receptacles particularly suitable for receiving a device, such as a fluorescent lamp, having a pair of contact pins extending from the end thereof for connection with an electrical supply, and particularly to such receptacles having contact elements therein that are closed together only upon the disposition of a lamp in the receptacle.

2. Description of the Prior Art

It has been previously recognized that in certain types of installations for fluorescent lamps, such as those with dimming controls or in fixtures for three or more lamps, it is desirable or required that the primary circuit including the ballast for the fluorescent lamp open or become deenergized whenever a lamp is removed from the lampholder. The purpose of deenergizing the primary circuit is to reduce shock hazard during insertion or removal of lamps in those applications where the voltage from the lampholder contacts to ground exceeds a certain rating (presently 180 volts rms) or the available current to ground exceeds a rated current (now 5 milliamperes) at rated ballast supply voltage when measured through a 500 ohm resistor.

It is customary in such applications to incorporate, in the contact means for one of the lamp pins, a switching means that is operative to open a circuit with the removal of the lamp. Contact elements for such switching mechanisms have taken various forms in the past. They are generally characterized by including a first contact element that is movable upon the insertion of a lamp within the holder to be forced laterally into contact with a second contact element thus closing the operative circuit. The reliability with which the conductive contact is made or broken is affected by the configuration of the contact elements and their housing. Some elements may become deformed in use so that upon lamp removal there is insufficient resiliency to separate the contacts or upon reinsertion of the lamp there is insufficient resiliency to reclose the contacts. Other factors including, of course, the cost of the lampholder enter into the design of such a lampholder and it was with such various criteria in mind that the present invention came about.

In copending application Ser. No. 3077, filed Jan. 15, 1970, by the present inventor and assigned to the present assignee, now U.S. Pat. No. 3,654,587, issued Apr. 4, 1972, an improved fluorescent lampholder was disclosed that included contact members held in place by projections within a housing including a front and back portion but with a pin contacting portion that is flat and parallel with the front wall and prevented from twisting out of parallelism by such projections but with sufficient resilience for lateral motion upon lamp pin insertion. One of the design criteria that led to the present invention was the objective of providing a circuit interrupting fluorescent lampholder with interruptable contact elements compatible with such contact members for normal pin contacting as are described in the mentioned copending application.

SUMMARY OF THE INVENTION

In accordance with this invention there is provided an electrical receptacle that is particularly suitable for holding and connecting for electrical energization the contact pins of a lamp, such as those of a fluorescent lamp, with means for opening the circuit on lamp removal. The device has a housing including a front body member and back cover member with various projections, particularly from the back member, for locating the various contact elements of the device, holding them in place merely by pressure between the housing elements, and yet permitting required motion of portions of the contact elements. The front body member has a front wall with an opening in it to receive lamp contact pins. Side walls extend rearwardly from the front wall and a central spacer extends rearwardly from the front wall and is located between and spaced from the side walls to define a pair of recesses. The projections from the back cover member include lamp contact pin guides extending within the opening in the front wall as well as contact member locating projections that extend within the recesses. A first contact means is provided within one of the recesses and is for normal lamp pin contacting. A second contact means in the other recess includes a pair of members that are in contact with each other only when one is laterally deflected as by a lamp pin being placed in the device. The member deflected by the lamp pin has a pin contacting portion that is substantially perpendicular with the front wall and has pin locating means thereon such as a pair of small projections within which the lamp pin is seated upon insertion.

The latter form of pin contacting portion is also useful in lampholders without interruptable contacts and offer advantages over those with known detent or concave pin contacting portions.

In a preferred form the contact members of the interruptable contact means are both thin metal elements the principal portion of each of which extends substantially parallel to the housing side wall and has a front edge with a notch in which is engaged a projection from the inner surface of the front wall.

It is preferred that the pin contacting portion of the first contact means is flat and parallel with the front wall and prevented from twisting of parallelism by said contact member locating projection of the back cover. While thus a preferred form of the invention includes contact members of 90° dissimilar orientation it will be seen that the elements are suitably located within the symmetrical recesses defined by the front housing members. Of course, if desired, a circuit interruptable contact means may be provided for both lamp pins but normally the expense of such a device is not justified.

In a more specific preferred form of the invention the second member of the circuit interrupting contact means has an extremity joined with the principal portion that is parallel with the side wall, which extremity extends substantially perpendicularly therefrom toward the principal portion of the other member of the circuit interrupting contact means with contacting being made between the edge of the extremity and the principal portion of the other member upon lateral deflection of the first member by a lamp pin to produce a wiping action between the contact members that assures good conductive contact therebetween even upon repeated operation.

PREFERRED EMBODIMENTS OF THE INVENTION

Figure 1:
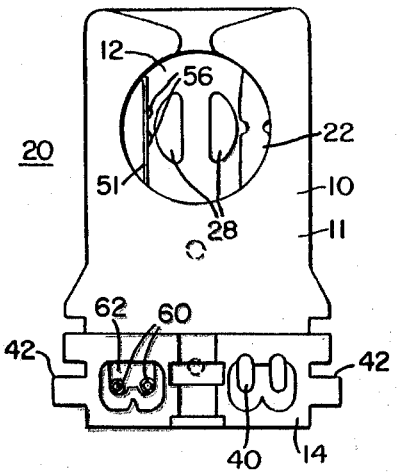
FIG. 1 is a front elevation view of an exemplary lampholder in accordance with this invention.

Referring to the drawings there is shown a fluorescent lampholder or the like comprising a front wall 11 having an opening 12 therein for receiving the pins of the lamp to be inserted. The front body member 10 has integrally formed therewith a base 14 extending frontwardly from the front wall 11. The lampholder also includes a back cover member 16 securable to the front body member 10, such as by a staple 18, and forming therewith a housing 20 that contains contact means for electrical contact to the pins of an inserted lamp.

Figure 3:
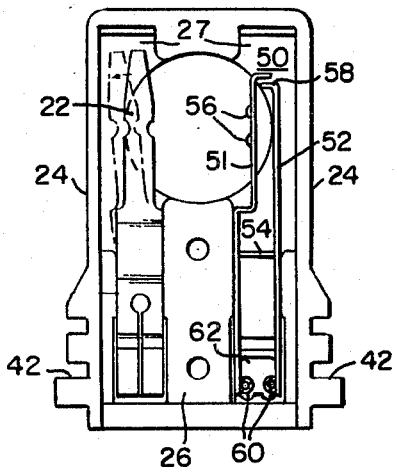
FIG. 3 is a rear elevation view of an assembled lampholder taken along the line III-III of FIG. 2.
Figure 2:
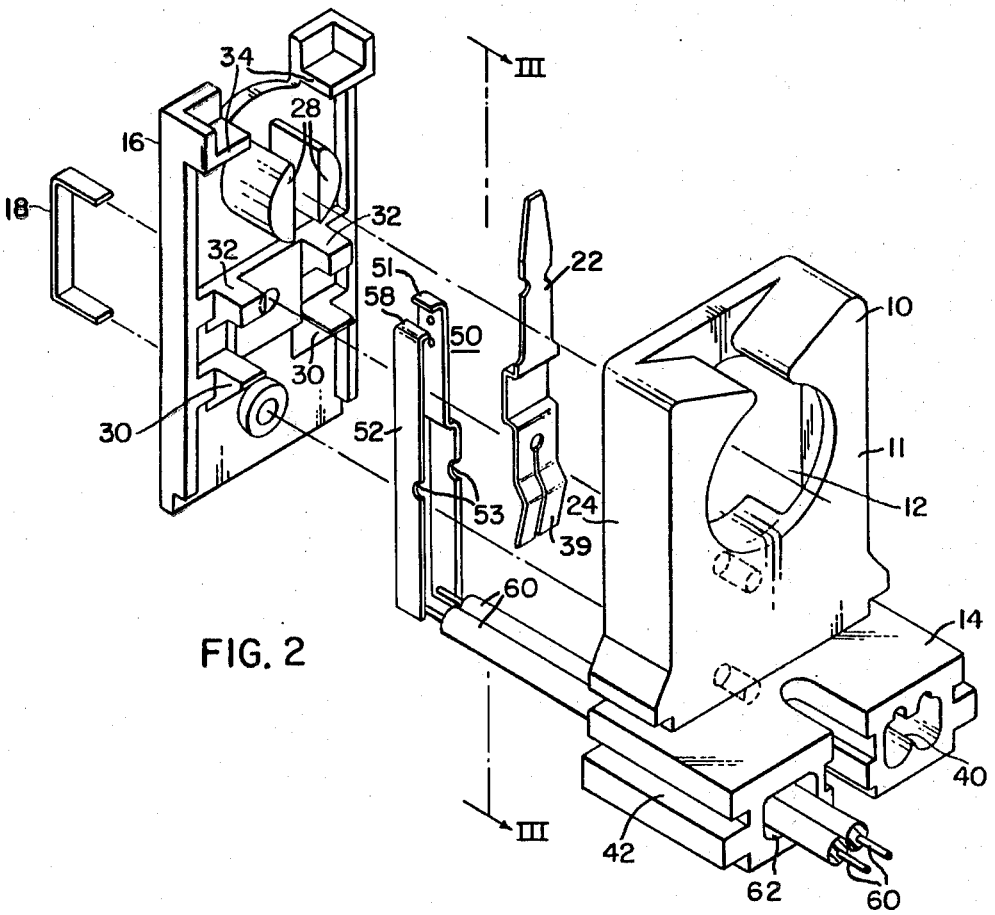
FIG. 2 is an exploded view, in perspective, of the lampholder of FIG. 1.

As shown in FIGS. 2 and 3, the front body member 10 has rearwardly extending side walls 24 and a rearwardly extending spacer 26 that is centrally located between the side walls. Between the side walls 24 and the spacer 26 are defined a pair of recesses 27 in which contact means of the device are located.

The back wall member 16 has a plurality of frontwardly extending projections. One pair of projections 28 are each of a half circular cross-section and are for guiding contact pins of an inserted lamp in relation with the contact elements of the lampholder. Other projections 30 and 32 from the back wall member 16 are for locating contact members within the housing 20. These projections extend within the recesses 27 of the front body member 10. Additional projections 34 are located in the upper corners of the back wall member for further limiting the motion of contact members. The contact means include a first contact means 22 for normal pin contacting of a single contact member that partially obstructs the opening 12 of the front wall and has an edge extending thereacross for contacting an inserted lamp pin. One of the contact pin guides 28 assists in the insertion and removal operations but is not essential in holding the lamp pin in place. The contact member 22 is characterized by a pin contact portion being flat and parallel with the front wall and prevented from twisting out of parallelism by the contact member locating projection 34 of the back cover. Further description of lampholders with contact members 22 will be had by reference to copending application Ser. No. 3077. Various other forms for contact member 22 may be used but are less preferred.

Contact member 22 is provided with a separation at its lower extremity 39. The two portions on each side of the separation of the extremity 39 are aligned with opening 40 within the base 14 for receiving wires and securing them in quick wiring terminal fashion by pressure contact between a separated end of the contact member and the adjacent housing surface. The base 14 is also configured with grooves 42 or the like for securing to a panel.

Contact means 50 is the circuit interrupting contact means that is provided in accordance with this invention. The means 50 comprises a pair of members 51 and 52 that in the assembled device are together located within one of the recesses 27. The first member 51 has a pin contacting portion extending across opening 12 for contacting a lamp contact pin. The second member 52 is adjacent the first member and is contacted by the first member 51 only when member 51 is laterally deflected as by a lamp pin. Both elements 51 and 52 are thin metal elements, a principal portion of each of which extends substantially parallel to the side walls. Elements 51 and 52 have a front edge with a notch 53 for engaging a projection 54 extending from the inner surface of the front wall 11.

The first member 51 has on the flat surface facing toward the center of the device a pin locating means 56 which in this example comprises a pair of projections between which the lamp pin is confined.

The second member 52 is characterized by having an extremity 58 that extends perpendicularly from the flat portion that is parallel to the side walls toward the member 51. The upper portion of member 52 which has extremity 58 is not constrained from lateral movement. Upon lamp insertion there is a wiping contact between the two contact members 51 and 52 to insure a good conductive path therebetween with repeatability. FIG. 3 illustrates the nature of the movement of the contact member 22 upon insertion of a lamp. For clarity of illustration the lateral movement of elements 51 and 52 is not shown. When a lamp is removed the contact members 51 and 52 swing back to their undeflected positions.

Insulated wires 60 extend through an opening 62 within the base 14 and are individually secured to each of the elements 51 and 52 for external electrical connection.

The illustrated form of contact member 51 is particularly useful in the circuit interrupting contact but it offers advantages that are attractive in other contact means. That is, a contact member 51 may be used in place of contact member 22 or a lampholder may be provided with two contact means each in the form of the single member 51.

The contact member 51 may be formed in a simple manner. The projections or bumps 56 may be formed by a stamping operation on the reverse surface from that on which the bumps are to be located. The remainder of the pin contacting portion of member 51 may be straight and flat, not requiring a detent or concave portion as in many former contact configurations. One advantage is that more contact movement is permitted as opposed to former configurations. Also, positive lamp positioning results that is readily felt by one who inserts lamps.

I claim:

1. An electrical receptacle particularly suitable for holding and connecting for electrical energization the contact pins of a lamp, such as a fluorescent lamp, and opening a circuit upon lamp removal, said receptacle comprising: a housing including a front body member and a back cover member; said front body member having a front wall with an opening therein to receive contact pins, side walls extending rearwardly from said front wall, a central spacer extending rearwardly from said front wall located between and spaced from said side walls to define a pair of recesses; said back cover member having a plurality of frontwardly extending projections including pin guides extending within said opening in said front wall, and contact member locating projections extending within said recesses; a first contact means for a first contact pin, said first contact means comprising a single member located in one of said recesses and having a pin-contacting portion extending across said opening for contacting a contact pin; a second contact means for a second contact pin, said second contact means comprising a pair of members located in the other of said recesses including a first member having a pin contacting portion extending across said opening for contacting a contact pin and a second member adjacent said first member and contacted by said first member only when said first member is laterally deflected, said first member pin contacting portion being substantially perpendicular with said first wall and having pin locating means thereon; said first and second members of said second contact means both being thin metal elements of which a principal portion of each extends substantially parallel to said side walls and has a front edge with a notch in which is engaged a projection from the inner surface of said front wall.

2. The subject matter of claim 1 wherein: said pin contacting portion of said contact member of said first contact means is flat and parallel with said front wall and prevented from twisting out of parallelism by said contact member locating projections of said back cover.

3. The subject matter of claim 1 wherein: said second member of said second contact means has an extremity joined with said principal portion and extending substantially perpendicularly therefrom toward said principal portion of first member with contact being made between the edge of said extremity and said principal portion of said first member upon lateral deflection of said first member by a lamp pin to produce a wiping action between said contact members.

4. The subject matter of claim 1 wherein: said pin locating means of said first member pin contacting portion comprises a pair of projections for locating a lamp pin therebetween.

5. An electrical receptacle particularly suitable for holding and connecting for electrical energization the contact pins of a lamp, such as a fluorescent lamp, said receptacle comprising: a housing including a front body member and a back cover member; said front body member having a front wall with an opening therein to receive contact pins, side walls extending rearwardly from said front wall, a central spacer extending rearwardly from said first front wall located between and spaced from said side walls to define a pair of recesses; said back cover member having a plurality of frontwardly extending projections including pin guides extending within said opening in said front wall and contact member locating projections extending within said recesses; a contact means in each of said recesses, at least one of said contact means comprising a thin metal member having a flat and straight lamp pin contacting portion that is substantially perpendicular to said front wall and parallel with said side walls, said lamp pin contacting portion having a pair of projections extending therefrom for locating a lamp pin therebetween.

* * * * *